United States Patent [19]

Nicolas et al.

[11] 4,414,833

[45] Nov. 15, 1983

[54] METHOD AND APPARATUS FOR BENDING A LONG METAL MEMBER

[75] Inventors: Jacques Nicolas, Bondues; Paul Lenglet, Bievres, both of France

[73] Assignee: Societe Anonyme dite: Stein Industrie, Velizy-Villacoublay, France

[21] Appl. No.: 290,044

[22] Filed: Aug. 5, 1981

[30] Foreign Application Priority Data

Aug. 5, 1980 [FR] France ..... 80 17297
Jan. 14, 1981 [FR] France ..... 81 00539

[51] Int. Cl.[3] ..... B21D 7/12; B21D 7/16

[52] U.S. Cl. ..... 72/13; 72/128; 72/369

[58] Field of Search ..... 72/13, 128, 342, 364, 72/369

[56] References Cited

U.S. PATENT DOCUMENTS

| | | | |
|---|---|---|---|
| 2,461,323 | 2/1949 | Hille | 72/342 X |
| 3,724,258 | 4/1973 | Hofstede et al. | 72/128 |
| 3,902,344 | 9/1975 | Stuart | 72/128 |
| 3,958,438 | 5/1976 | Somov et al. | 72/128 |
| 4,056,960 | 11/1977 | Kawanami | 72/128 |
| 4,061,005 | 12/1977 | Kawanami et al. | 72/128 X |
| 4,062,216 | 12/1977 | Hanamoto et al. | 72/128 |
| 4,098,106 | 7/1978 | Yamaguchi | 72/128 |
| 4,122,697 | 10/1978 | Hanyo et al. | 72/128 |
| 4,151,732 | 5/1979 | Hofstede et al. | 72/128 X |
| 4,177,661 | 12/1979 | Schwarzbach et al. | 72/128 |
| 4,195,506 | 4/1980 | Kawanami et al. | 72/128 X |
| 4,254,649 | 3/1981 | Cervenka et al. | 72/128 |

*Primary Examiner*—Ervin M. Combs
*Attorney, Agent, or Firm*—Sughrue, Mion, Zinn, Macpeak, and Seas

[57] ABSTRACT

A method of bending a long metal member of constant cross-section by locally heating a narrow zone on the periphery of said member by means of a heating collar (5) which surrounds said zone, by exerting thrust (2) on one end of the member and by supporting its other end by means of a pivoting arm (3). The temperature of the heated zone on the periphery of the member is kept substantially constant by detecting the temperature of this zone or the size of the gap which separates the heating collar from the periphery of said zone at at least two points around said periphery, one of these points being nearest the center of curvature and the other being on the opposite side to the first. The input of heat at one or other of these points is increased or reduced according to whether the temperature is lower or higher than a nominal temperature at said point, or to whether the gap is greater or smaller than a nominal gap at said point, said nominal values of temperature and gap corresponding to uniform heating around said periphery.

20 Claims, 7 Drawing Figures

METHOD AND APPARATUS FOR BENDING A LONG METAL MEMBER

The present invention relates to a method of bending a long metal member of constant cross-section by locally heating a narrow zone on the periphery of said member by means of a heating collar which surrounds said zone, by exerting thrust on one end of the member and by supporting its other end by means of a pivoting arm. It applies in particular to bending large-diameter pipes and also to bending bars, extruded sections, etc. It also relates to apparatus for performing the method.

BACKGROUND OF THE INVENTION

Such methods deform the cross-section of the long metal member in the heating zone. This causes a portion of the periphery of the metal member to be moved away from the collar, while another portion of the periphery moves towards it. The first portion is therefore not heated to as high a temperature as the second, which can cause geometrical and metallurgical defects.

The present invention aims to remedy this drawback and to provide a method and apparatus for bending a long metal member which method and apparatus avoid such defects.

SUMMARY OF THE INVENTION

The present invention provides a method of bending a long metal member of constant cross-section by locally heating a narrow zone on the periphery of said member by means of a heating collar which surrounds said zone, by exerting thrust on one end of the member and by supporting its other end by means of a pivoting arm, wherein the temperature of the heated zone on the periphery of the member is kept substantially constant by detecting the temperature of this zone or the gap which separates the heating collar from the periphery of this zone at at least two points of this periphery, one of these points being nearest the centre of curvature and the other being on the opposite side to the first, and by increasing or reducing the input of heat at one or other of these points according to whether the detected temperature is lower or higher at one point or another or to whether the collar-member gap is greater or smaller at one point or another compared with a nominal value which corresponds to uniform temperature or to a uniform gap around the periphery of the heated zone.

Further, it preferably has at least one of the following features.

The temperature of the heated zone or the gap which separates the heating collar from the periphery of the member are measured at four points at 90° to one another.

The temperature of the heated zone is measured by means of sensors which are made to move in a reciprocating movement parallel to the axis of the yet unbent member and scanning the width of the heated zone.

The temperature of the heated zone is detected by directing this zone firstly by setting the axes of a first set of sensors in the direction of the heated zone so that said axes form an acute angle with the axis of the yet unbent member and secondly by means of a second set of sensors spaced out longitudinally apart from the first set and set in a direction such that they can observe the portion of the heated zone which the heating collar can screen from the first set of sensors during part of the bending operation.

The gaps are measured by means of sensors which control servomotors, providing firstly an overall movement of the heating collar and secondly a deformation of said collar.

The input of heat is increased or reduced in the detection zones by supplying constant power to a heating collar, which power corresponds to the minimum deformation temperature of the heated zone of the long member and by bringing additional heating elements disposed facing the detection zones closer together or further apart or by modifying the power supplied to these heating elements.

The invention also provides apparatus for bending a long metal member whose cross-section is constant, said apparatus including a heating collar which surrounds the zone to be heated to allow bending, means for pushing said member and a pivoting arm to support the other end of the member, wherein said apparatus further includes means for detecting the temperature of the heated zone or of the gap which separates the heating collar from the periphery of the member at at least two points of the periphery, one point being on the side nearest the centre of curvature and the other point being on the opposite side and means for increasing or reducing the input of heat at one or the other of these points according to whether the temperature is lower or higher, or said gap is greater or smaller, there, than a nominal value which corresponds to uniform temperature or to a uniform gap, around the periphery of the heated zone.

This apparatus preferably includes at least one of the following features.

It includes four infrared radiation temperature detectors disposed at 90° from one another.

It has temperature detectors as well as means for longitudinally moving the detectors in a reciprocating movement allowing them to scan the width of the heated zone.

It includes temperature detectors, connected via a multiplexing device firstly to distinct temperature recorders, and secondly to a peak detect and hold circuit and to a unit for displaying the peak temperature, as well as a device for displaying temperatures successively in the same recorder.

The detection means are connected to servomotors to control both the overall movement of the heating collar and also to deform the heating collar.

The heating collar consists of an inner collar which supplies a constant power corresponding to the minimum deformation temperature of the heated zone and of additional heating elements disposed facing the detection zones and the apparatus further includes means for bringing the additional heating elements closer to or further from the long metal member or to modify the power which is supplied thereto.

BRIEF DESCRIPTION OF THE DRAWINGS

Embodiments of the invention are described by way of example and with reference to the FIGURES of the accompanying drawings, in which.

DESCRIPTION OF PREFERRED EMBODIMENTS

Figure 1:
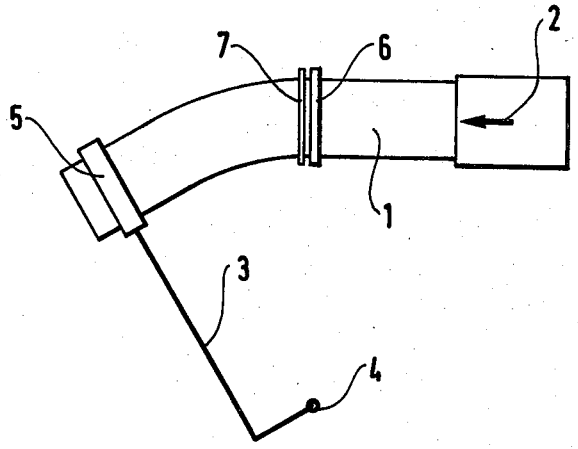
FIG. 1 schematically illustrates an apparatus in accordance with the invention for bending a large- diameter pipe.

In FIG. 1, a mechanical apparatus applies thrust, represented by an arrow 2, to one end of a pipe to be bent, while a moving arm 3 rotatably mounted on a pin 4, supports the other end of the pipe by means of a collar 5. An induction collar 6 provides heating over a suitably wide zone in which the pipe is to be deformed. The induction collaris followed by an air-cooled or water-cooled cooling apparatus 7.

Figure 2:
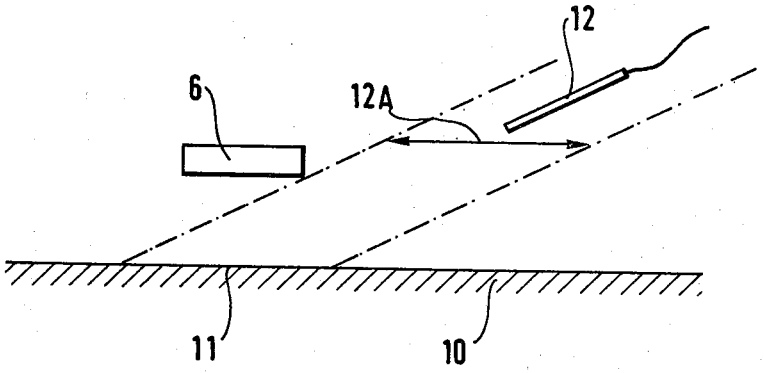
FIG. 2 illustrates the position and the movement of a temperature-measuring sensor.

FIG. 2 is a cross-section through the axis of the pipe to be bent. The wall of the pipe is referenced 10. Zone 11 is to be heated and is therefore surrounded by the induction collar 6. An infrared sensor 12 is disposed upstream from the heated zone in the direction of induction collar movement and is inclined so as to be capable of being aimed at any part of the heated zone without interference from the induction collar. Means which are not illustrated drive the sensor in a reciprocating movement indicated by the two-headed arrow 12A so as to be able to record the temperature of the whole length of the heated zone and, in particular, the maximum temperature.

Of course, other sensors are disposed at other points around the periphery of the pipe, e.g. three other sensors all at 90° to one another.

Figure 3:
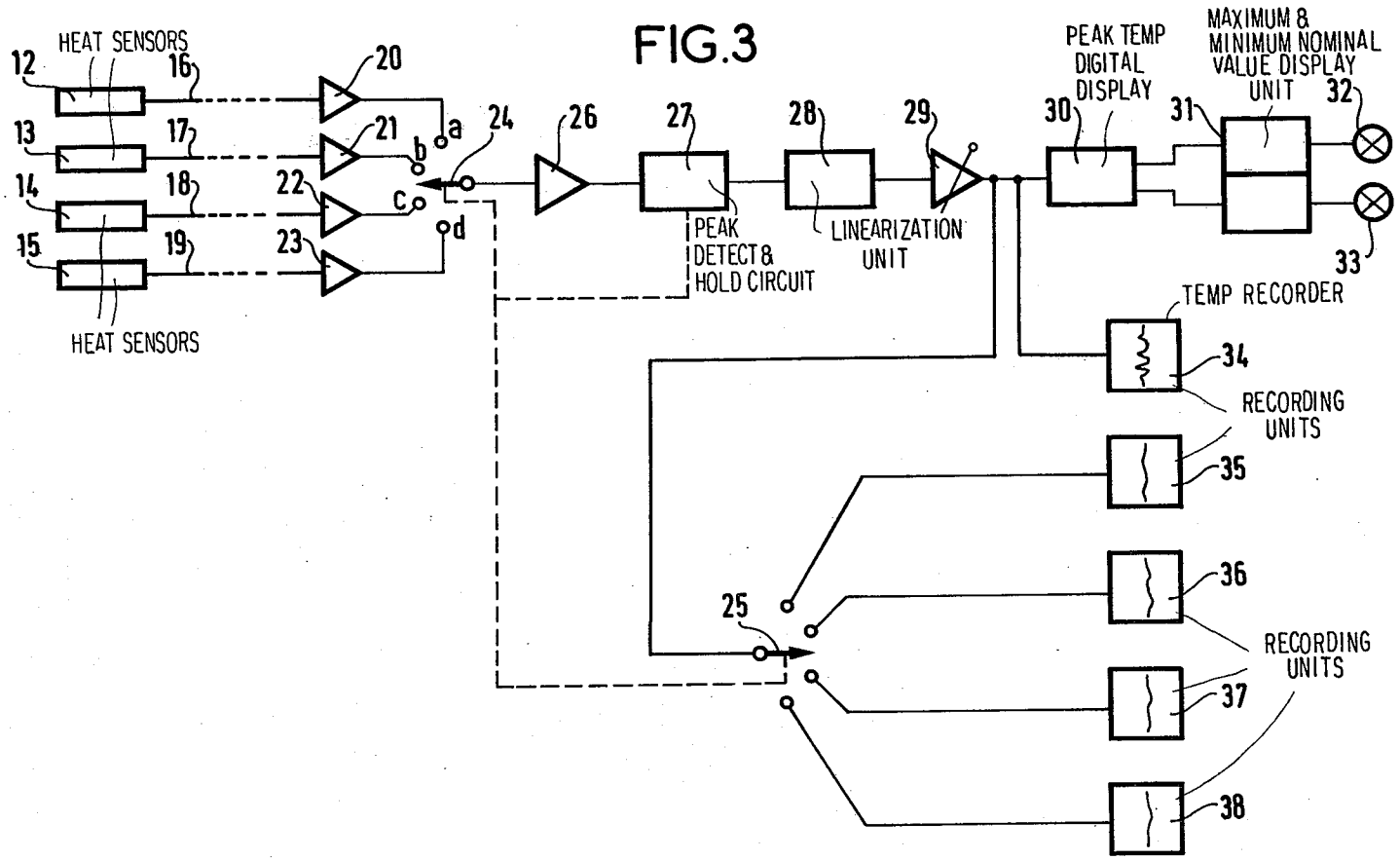
FIG. 3 illustrates a system used in the apparatus of FIG. 1 for analysing the temperature at four points on the periphery of a pipe which are at 90° from one another.

FIG. 3 illustrates a temperature analysis system which uses four sensors such as the one shown in FIG. 2. Each of the sensors 12, 13, 14, 15 is connected by an optical fibre 16, 17, 18, 19 to a respective optical amplifier 20, 21, 22, 23. The four amplifiers are connected to a multiplexer 24 with terminals a, b, c, d. Multiplexing is controlled by a moving contact 25 (or functionally analogous electronic circuit. The multiplexer is followed by an amplifier 26, followed by a peak-detect and hold circuit 27 which is connected via a linearization unit 28 and a weighting circuit 29 for setting the emmissivity coefficient, firstly to a digital display unit (30–33) and secondly to a temperature recorder (34–38).

A peak temperature digital display 30 is connected to a maximum and minimum nominal value display unit 31 which is itself connected to warning lights 32, 33. The recording unit 34 registers all four temperature readings successively on the same graph.

Further, distinct recording units 35, 36, 37, 38, connected to a moving contact 25 (or functionally analogous electronic circuit), display the variations in temperature as observed by each of the sensors.

Figure 4:
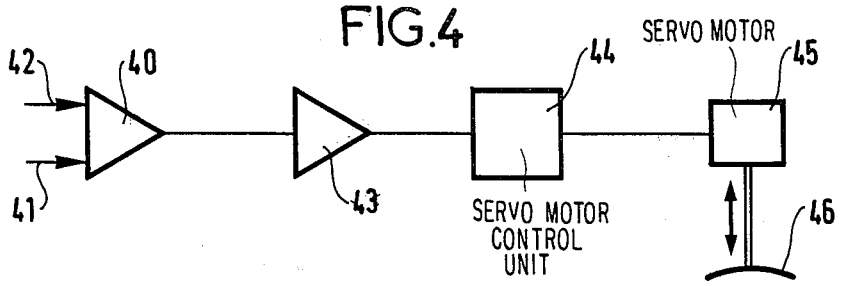
FIG. 4 schematically illustrates apparatus for adjusting the inductor as a function of the temperature read by the sensor.

In FIG. 4, a comparator 40 receives data relating firstly to the temperature read by a sensor (arrow 41) and secondly to the reference temperature (arrow 42) and delivers a signal which gives the value of their difference in amplitude and in sign. This signal is transmitted to an amplifier 43, then to a servomotor control unit 44. The servomotor 45 exerts pressure or traction on a variable-geometry inductor 46. If the detected temperature is lower than the reference temperature, the servomotor brings the inductor closer to the surface of the pipe. If the detected temperature is higher than the reference temperature, the servomotor brings the inductor away from the surface of the pipe.

Figure 5:
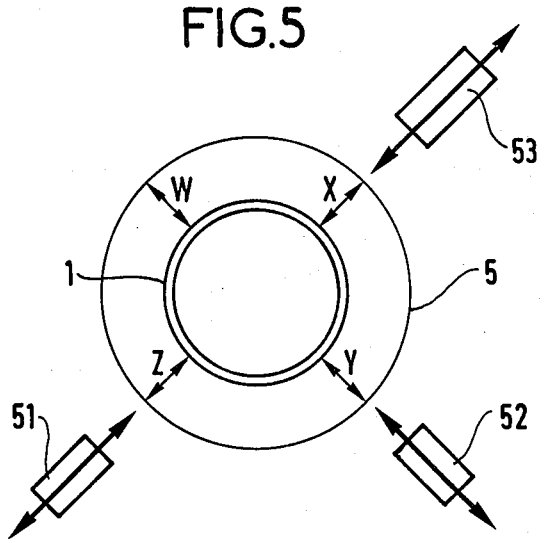
FIG. 5 schematically illustrates the disposition of servomotors controlled by the air gap sensor.

FIG. 5 is a cross-section through the heated zone of the pipe 1, which zone is surrounded by an induction collar 5 which is surrounded by servomotors 51 and 52 which provide for its overall movement and by servomotor 53, which deforms it. Sensors, not shown, measure the temperature in gaps W, X, Y, Z, spaced at 90° from one another. They transform the temperature measurements in these gaps into electric signals w, x, y, z. For example, the signals w and y are compared so as to drive the servomotor 52 when the difference between them $(w-y)$ is different from 0 and the signals x and z are compared so as to drive the servomotor 51 if $x-z$ is different from 0. Then the quantities $(w+y)$ and $(x+z)$ are summed and compared so as to drive the motor 53 if the difference $(w+z)-(x+z)$ is different from 0.

Figure 6:
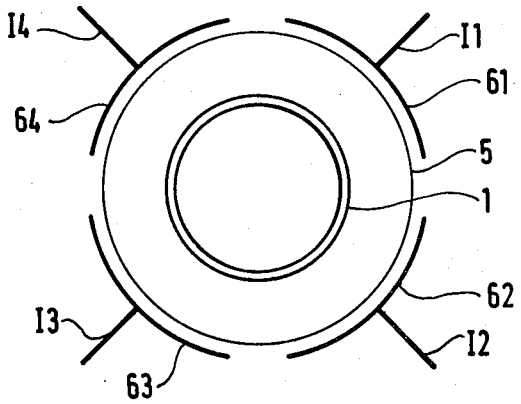
FIG. 6 illustrates the disposition of an inductor with an inner collar and moving or adjustable power additional inductors.

In FIG. 6, the heated zone of the pipe 1 is surrounded by an induction collar 5 whose shape corresponds to the theoretical shape (circular in this case) of the pipe. It is surrounded by four additional inductors 61, 62, 63, 64, spaced at 90° from one another and having the same axes as the temperature sensors. The inductor 5 is coaxial with the pipe and the power with which it is fed is such that each sensor is responsive to the minimum temperature for deformation. The temperature observed for each sensor is compared with the nominal temperature and the value of the difference controls an application of electric power into the corresponding additional inductor or a movement thereof to vary the gap between it and the pipe.

Figure 7:
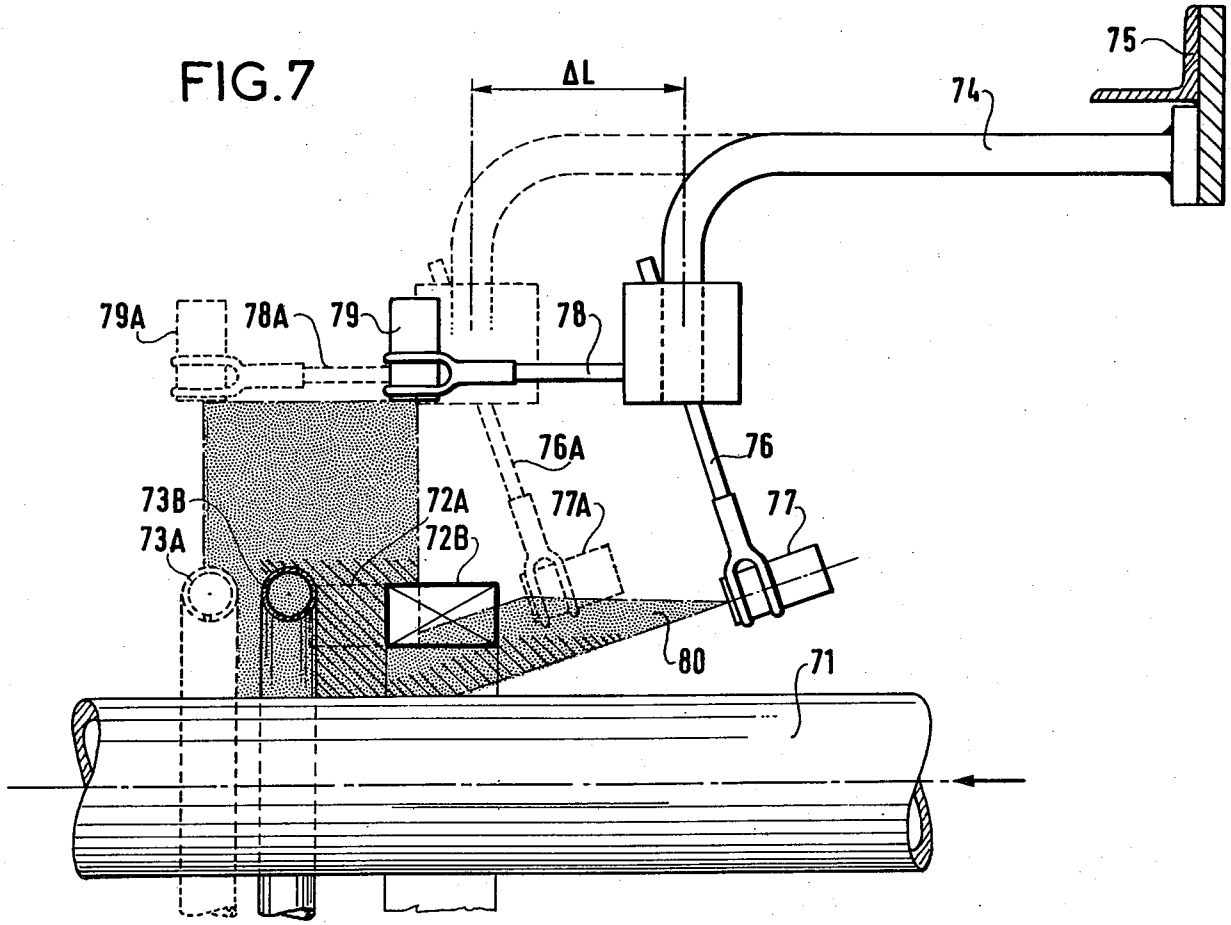
FIG. 7 shows bending apparatus with two sets of sensors spaced longitudinally from each other.

The apparatus illustrated in FIG. 7 aims to overcome a difficulty which results from the fact that on performing the method, it is necessary to move the heating collar backwards during operation since the heated zone tends to move forwards because the metal pipe advances and is not instantaneously heated. When the temperature of the heated zone is detected by temperature sensors which are disposed so as to form relative to the axis an angle which is sufficiently acute to enable the sensors to detect the temperature of the heated zone beneath the heating collar, it has been found, in practice, that the sensors only have a part of the heated zone, in their line of sight with the remainder being screened by the heating collar.

The method which corresponds to the device illustrated in this FIGURE aims to overcome this disadvantage and to allow constant observation of the peak temperature all around the periphery of the heated zone and consequantly to enable input of heat around the periphery of the component which is to be bent to be suitably corrected and to reduce as far as possible defects in the shape of the bent metal component.

In the device of FIG. 7, the pipe 71 is pushed in the direction of the arow. During the initial preheating period, a heating collar 72 is disposed in position 72A, from which it is moved back to position 72B during the bending operation. A torus for water spray cooling is moved back with the heating collar from its initial position 73A to position 73B.

Infrared radiation temperature detectors are carried by arms 74 fixed to a moving support 75. For clearness' sake, only one arm 74 is illustrated in the FIGURE, but it is obvious that in fact, a plurality of arms are spaced out around the periphery of the pipe, e.g. four arms at 90° to one another. The arm 74 has two clips to grip the detectors, a clip 76 carrying a detector 77 whose axis is directed to form an acute angle with the pipe advance axis and a detector 79 whose axis is directed perpendicular to said advance axis. The moving support and the arm are driven in a reciprocating movement whose amplitude is ΔL.

Therefore, during a reciprocating period, the arm 76 and the detector 77 advance up to positions 76A and 77A then return to their initial positions. Likewise, arm 78 and detector 79 move forward up to positions 78A and 79A, then return to their initial positions. During the initial preheating step, the field scanned by the detectors is illustrated by a shaded portion 80 in the FIGURE. Subsequently the detector 77 scans the whole of the heated zone. When the heating collar has been moved back towards position 72B, the heated zone is partially screened from the detector 77 but the remainder of this zone is in the field scanned by the detector 79. Thus, using respective temperature peak detection multiplexing chains for both the detectors 77 and 79 and them comparing the maximum values and selecting the highest value, it is possible to obtain the maximum temperature at all times on the various generator lines of the periphery of the heated zone and the input of heat on each of the corresponding sectors thereof can be suitably corrected.

Within the scope of the invention, assymmetric heating of the heated zone could be detected by measuring physical properties other than infrared radiation or the gap.

We claim:

1. In a method of bending a long metal member of constant cross-section about a center of curvature by locally heating a narrow zone on the periphery of said member by means of a heating collar which surrounds said zone, said collar being spaced from the member by a radial gap, exerting thrust on one end of the member and supporting its other end by means of a pivoting arm, the improvement comprising:

keeping the temperature of the heated zone on the periphery of the member substantially constant by detecting the temperature of said zone or the radial gap which separates the heating collar from the periphery at said zone, at at least two points about said periphery, one of said points being nearest to the center of curvature and the other being furthest from the center of curvature, and increasing or reducing the input of heat at said one or said other of said points according to whether the detected temperature is lower or higher at said one point or said other point compared with a nominal value which corresponds to a uniform temperature of the heated zone around the periphery.

2. A method according to claim 1, wherein the temperature of the heated zone is measured at four circumferential poinfts at 90° to one another.

3. A method according to claim 1, wherein the temperature of the heated zone is measured by moving heat sensors positioned upstream from the heating collar in a reciprocating movement parallel to the axis of the member in the direction of the applied thrust and scanning the width of the heated zone.

4. A method according to claim 3, wherein the temperature of the heated zone is detected by setting the axes of a first set of heat sensors in the direction of the heated zone so that said axes form an acute angle with the axis of the member and secondly by setting a second set of heat sensors spaced out longitudinally apart from the first set and set in a direction such that they can observe a portion of the heated zone which is otherwise screened by the heating collar from said first set of sensors during part of the bending operation.

5. A method according to claim 4, wherein the heated zone is observed by setting the second set of sensors perpendicular to said axis of the member and keeping the second set at a fixed distance from the first set to allow it to observe the portion of the heated zone which is downstream in the direction of applied thrust from the heating collar at least during the interval of time in which this portion is screened off from the first set of sensors by said heating collar.

6. A method according to claim 4, further comprising the steps of continuously comparing the temperatures observed by said first and second sets of sensors and taking the highest values observed by either into consideration to vary the input of heat to the corresponding sectors of the heated zone.

7. A method according to claim 1, wherein the temperature of the zones are measured by sensors, and said method further comprises controlling servomotors operatively engaging the heating collar to effect first an overall movement of the heating collar relative to said member at said zone and secondly a radial deformation of said collar at said one point or said other point.

8. A method according to claim 1, wherein the input of heat is increased or reduced in the detection zones by supplying constant power to said heating collar to bring said member to a temperature allowing minimum bending deformation under the exerted thrust and by bringing additional heating elements disposed facing respective detection zones radially closer together or further apart relative to said member at said narrow zone or by modifying the power supplied to said additional heating elements.

9. Apparatus for bending a long metal member whose cross-section is constant about a center of curvature, said apparatus including a heating collar surrounding said long metal member for heating a narrow zone on the periphery of said member to allow bending, means applying a force on one end of said member for pushing said member, a pivoting arm supporting the end of the member opposite that receiving said applied force, said heating collar being spaced radially from said member to provide a radial gap therebetween, the improvement wherein said apparatus further includes; means for detecting the temperature of the heated zone or said radial gap which separates the heating collar from the periphery of the member at at least two points within said heating zone about said periphery, one point being nearest the center of curvature and the other point being furthest from the center of curvature, means for increasing or reducing the input of heat at said one or said other of said points according to whether the temperature at said one point or said other point is lower or higher than a nominal value which corresponds to the uniform temperature around the member periphery at the heated zone.

10. Apparatus according to claim 9, wherein said means for detecting the temperatures of the heated zone or of the gap that separates the heating collar from the periphery of said member comprises four infrared radiation temperature detectors disposed about the periphery of said member and circumferentially spaced 90° from one another.

11. Apparatus according to claim 9, further including means for longitudinally moving said infrared radiation temperature detectors in a reciprocating movement parallel to the axis of the member to allow them to scan the width of the heated zone.

12. Apparatus according to claim 9, further comprising a multiplexing device, individual distinct temperature recorders for each detector, a peak detect and hold circuit for detecting the peak temperature sensed by each of said detectors, and a display unit and means for connecting said detectors via said multiplexing device to the distinct temperature recorders, to said peak detect and hold circuit and to a unit for displaying the peak temperature.

13. Apparatus according to claim 12, further comprising a device for displaying temperatures successively for all of said detectors in a single recorder, and means for operatively connecting said device to said detectors, via said multiplexing device.

14. The apparatus according to claim 9, further comprising servomotors operatively connected to said heating collar for controlling the overall movement of the heating collar relative to said member and for locally radially deforming said heating collar, and means for operatively connecting said servomotors to said detection means.

15. Apparatus according to claim 9, wherein said heating collar consists of an inner collar, means for supplying a constant power to said inner collar to raise the temperature of the heated zone to that effecting minimum bending deformation of said member in response to said force application means, said collar further consisting of additional heating elements disposed facing the detection zones and wherein said apparatus further includes means for radially shifting said heating elements relative to said long metal metal member or for modifying the power supplied thereto for varying the heat output of said additional heating elements.

16. Apparatus according to claim 15, wherein the additional heating elements are inductors.

17. Apparatus according to claim 9, wherein the heating collar is an induction collar.

18. Apparatus for bending a long metal member about a center of curvature, said apparatus including a heating collar which surrounds the long metal member and being spaced radially therefrom by a radial gap and which functions to heat a narrow zone on the periphery of said member to allow bending of said long metal member, means applying an axial force on one end of said member for pushing said member, a pivoting arm coupled to the end of said member to the opposite side of said heating collar from the end bearing said applied axial force, detectors for detecting the temperature of the heated zone at at least two points about the periphery of said long metal member, means for effecting longitudinal reciprocating movement of said detectors parallel to the axis of the long metal member to enable said detectors to scan the width of the heated zone, means for increasing or reducing the thermal input of said heating collar at said one or said other of said points, according to whether the temperature at said one or said other point is higher or lower than a nominal value which corresponds to a uniform temperature at the member periphery of the heated zone, and wherein said detectors include a first set of sensors disposed upstream from the heated zone whose axes are directed at an acute angle with the axis of the long metal member, and a second set of sensors spaced longitudinally apart from said first set and being directed relative to said zone so as to allow said second set of sensors to observe a portion of the heated zone which is screened off from the first set of sensors by said heating collar during part of the bending operation.

19. Apparatus according to claim 18, wherein said second set of sensors is disposed perpendicularly to the axis of long metal member, and wherein said apparatus further comprises means for connecting said first set of sensors to said second set of sensors to maintain them spaced apart by a fixed distance such that said second set of sensors is adjacent the portion of the heated zone downstream from the heating collar during the interval of time when that portion is screened off from said first set of sensors.

20. Apparatus according to claim 18, further including a multiplexing device, comparators for comparing the temperatures observed by corresponding sensors of both sets, temperature recorders, to a peak detector for each sensor, a display device for displaying the maximum temperatures sensed by said sets of sensors, and means for connecting said sensors to said comparators through said multiplexing device, and said comparators to said device for displaying the maximum temperatures experienced by said sensors.

* * * * *